US008786416B2

(12) United States Patent
Saguin et al.

(10) Patent No.: US 8,786,416 B2
(45) Date of Patent: Jul. 22, 2014

(54) INSTALLATION FOR CONTROLLING THE PLAYING TIME OF A SPORTING EVENT

(75) Inventors: Pascal Saguin, Saint Pierre d'Allevard (FR); Pascal Champaney, Letouvet (FR); Philippe Turlier, Sassebage (FR)

(73) Assignee: Adeunis R F (FR)

( * ) Notice: Subject to any disclaimer, the term of this patent is extended or adjusted under 35 U.S.C. 154(b) by 560 days.

(21) Appl. No.: 12/917,639

(22) Filed: Nov. 2, 2010

(65) Prior Publication Data

US 2012/0002509 A1 Jan. 5, 2012

(30) Foreign Application Priority Data

Jun. 30, 2010 (FR) ..... 10 02728

(51) Int. Cl.

| | |
|---|---|
| ***A63B 69/00*** | (2006.01) |
| ***G08C 23/02*** | (2006.01) |
| ***A63B 71/06*** | (2006.01) |
| ***G07C 1/22*** | (2006.01) |

(52) U.S. Cl.

CPC ..... *G08C 23/02* (2013.01); *A63B 2220/62* (2013.01); *A63B 71/0616* (2013.01); *G07C 1/22* (2013.01); *A63B 2243/0037* (2013.01)

USPC ..... 340/323 R; 368/10; 381/58

(58) Field of Classification Search

USPC ..... 340/323 R; 381/58, 122; 368/10

See application file for complete search history.

(56) References Cited

U.S. PATENT DOCUMENTS

| | | | | |
|---|---|---|---|---|
| 4,215,856 | A | 8/1980 | Schmall et al. | |
| 5,065,251 | A | 11/1991 | Shuhart, Jr. et al. | |
| 6,603,711 | B2 * | 8/2003 | Calace | 368/10 |
| 2007/0010335 | A1 | 1/2007 | Al-Sabah | |
| 2010/0085167 | A1 | 4/2010 | Costabile | |

FOREIGN PATENT DOCUMENTS

| | | |
|---|---|---|
| GB | 2381202 | 4/2003 |
| WO | 0073858 | 12/2000 |

* cited by examiner

*Primary Examiner* — Thomas Mullen

(74) *Attorney, Agent, or Firm* — Cantor Colburn LLP

(57) ABSTRACT

A control installation of the playing time of a sporting event, in particular of the basketball game type, includes a portable acquisition and detection system of a whistle signaling the stoppage of the playing time, the portable system converting the acoustic signals into digital signals, digitally processing these digital signals and delivering a digital refereeing signal in response to the detection of the whistle. The control installation further includes a fixed system for controlling the playing time in digital radio connection with the portable system and a controller for controlling the stoppage and/or restarting of a stopwatch counting down the playing time in response to the reception of the digital refereeing signal.

16 Claims, 2 Drawing Sheets

| TS6 | TS1 | TS2 | TS3 | TS4 | TS5 | TS6 | TS1 |
|---|---|---|---|---|---|---|---|
| | Sync + Voix + Mes1 | Mes2 | | Voice | S23 | | |

| TS6 | TS1 | TS2 | TS3 | TS4 | TS5 | TS6 | TS1 |
|---|---|---|---|---|---|---|---|
| | Sync + Voix + Mes1 | Mes2 | | Voice | | AR | |

| Header | Voice | Mes1 | Mes2 | S23 | CRC + EOF |
|---|---|---|---|---|---|
| | XXXX | YYYY | ZZZZ | 1 | |

INSTALLATION FOR CONTROLLING THE PLAYING TIME OF A SPORTING EVENT

TECHNICAL FIELD

The present invention concerns a portable system for the acquisition and detection of a so-called refereeing acoustic signal, signaling a stop and/or resumption of playing time for a sporting event, intended to be carried by a referee for the sporting event.

It also concerns an audio-digital communication terminal, for audio communication between several referees, integrating such a portable acquisition and detection system.

It also concerns a fixed system for monitoring the playing time of the sporting event, intended to be in wireless connection with such a portable acquisition and detection system, as well as an installation for monitoring the playing time comprising such a fixed monitoring system in wireless connection with such a portable acquisition and detection system.

BACKGROUND

During certain sporting events, and in particular during basketball matches or other team sports governed by the same type of playing time rules as basketball, it is common practice that each time a stoppage is called by one of the referees, usually the head referee, or the only referee present, the playing time countdown is stopped. In this way, only actual periods of play are taken into account to assess the playing time for the game in progress, and interruptions due in particular to replacements of players, injuries, fouls, etc. are not counted against the playing time.

These sporting events are thus subject to the stopwatch or chronometer, which traditionally counts down the playing time, and any referee intervention must cause that stopwatch to be stopped from counting down the playing time, in other words to avoid taking these interruptions in the game into account in the overall playing time allocated for the game in progress.

In many cases, the referee signals the stop of the playing time by blowing a whistle; the whistle generally being duly approved and referenced by the federation in charge of these sporting events or any other sworn organization for these sporting events. It is also possible for this same referee to signal the resumption of playing time by blowing this same whistle, which then triggers the start or restart of the stopwatch.

In certain sports, such as basketball, the playing phases are particularly quick and broken up, with many play stoppages during the match, such that forgetting or delays in stopping the stopwatch are regular and cause disputes that are always delicate for the referees to resolve.

To respond to this issue, it is known to use systems for automatically detecting the blowing of the whistle and stopping the stopwatch. It is thus known from document EP 0 712 508 B1 to use a remotely controlled timing installation that includes:

- several portable systems each provided, on one hand, with a microphone that measures external sounds and delivers raw analog measuring signals and, on the other hand, a remote controlled portable transmitter that transmits these raw measuring signals; and
- a fixed system comprising a radio receiver placed on the scoreboard, in radio connection with the remote controlled portable transmitters, followed by a mixer that mixes the raw analog measuring signals, then a high-pass filter and low-pass filter assembly, then an electronic control circuit that delivers a switching signal intended for the stopwatch.

The connection between the portable systems and the fixed system is thus done using an analog radio transmission, in modulated frequency, in frequencies selected to be separate from the transmission frequencies of the external electronic equipment such as television cameras, equipment for communicating with the security team, etc.

The detection of the whistle is done in the fixed system, in other words at the scoreboard, in particular using a high-pass filter whereof the cutoff frequency corresponds substantially to the whistle transmission frequency, so as to allow frequencies higher than the cutoff frequency (or whistle frequency) to pass and attenuate frequencies below the cutoff frequency.

However, this type of remote controlled stopwatch installation has many drawbacks due primarily to the analog radio connection between the portable systems and the fixed system.

Indeed, this analog radio connection deforms and colors the transmitted analog signals and modifies the signature thereof, thereby affecting the reliability of their detection.

Indeed, the components used for the transmission, the transmission and the analysis of the analog signals have unique characteristics (bandwidth, distortion, different filtering effects, etc.), which permanently modify the analog signal. The system is then said to color the analog signal, in other words to modify the spectral response of said analog signal. Each transformation of the analog signal generated by these components necessarily generates background noise because each component creates some. The major drawback of an analog system is the irreversible degradation of the analog signal, the system being incapable of distinguishing the useful signal from the background noise.

Thus, the wireless radio being analog, there is no means for recapturing a communication if it is scrambled, or even of detecting the failure of the system such that, on one hand, whistles cannot be detected by the fixed system following electromagnetic disruptions caused by external electronic apparatuses and, on the other hand, these same external electronic apparatuses can disrupt the transmitted analog signal to the point of erroneously triggering the stoppage of the playing time.

Moreover, in the case of the installation disclosed in document EP 0 712 508 B1, the detection of the whistle is done after the scoreboard radio receiver, with a simple band-pass analog filtering that is intended to detect the frequency of the whistle. It has, however, been observed, with this type of installation, that any acoustic signal having a frequency component of the same nature, such as for example whistles belonging to the general public, the screech of shoe soles on the ground, etc. is interpreted as a whistle, thereby triggering an undesired stoppage of the stopwatch.

Thus, this installation using analog communication systems has a lack of reliability that is sometimes crippling, as it is a source of conflicts between the teams and referees, when the whistles transmitted by the referee are not detected and when external sounds (whistles belonging to the general public, screeching of shoe soles, etc.) erroneously trigger the stoppage of the stopwatch.

Some systems, approximately similar to the one described into document EP 0 712 508 B1, are also known from documents U.S. Pat. No. 5,065,251, U.S. Pat. No. 3,651,507, SU 1409301 A1, FR 2 387 479 A and PT 97 522.

BRIEF SUMMARY

The present invention aims to resolve these drawbacks by proposing a portable system for the acquisition and detection of a so-called refereeing acoustic signal, in particular of the whistle type, that allows reliable detection of the refereeing acoustic signal and does away with any faulty analog radio connection.

One aim of the present invention is to provide a portable system for the acquisition and detection of the refereeing acoustic signal that makes it possible to verify the proper operation and availability of the system.

Another aim of the present invention is to provide a portable system for the acquisition and detection of the refereeing acoustic signal that avoids false triggering of the stoppage of the playing time due to radio disruptions or external sounds.

Another aim of the present invention is to provide an audio-digital communication terminal that integrates such a portable acquisition and detection system, thereby making it possible to use a same terminal for audio communication between several referees and to detect the whistle.

Another aim of the present invention is to provide a fixed system for controlling the playing time intended to be in wireless connection with such a portable acquisition and detection system, where the fixed system is particularly adapted for this portable system.

Another aim of the present invention is to provide a fixed system for controlling the playing time that has a simple design and allows quick and reliable stoppage of the game time.

Another aim of the present invention is to provide an installation for controlling the playing time comprising at least one such portable system and one such fixed system, that allows reliable detection of the whistle that avoids incorrect triggering of the stoppage of the playing time.

To that end, it proposes a portable system for acquisition and detection of a so-called refereeing acoustic signal, in particular of the whistle type, signaling a stop and/or resumption of the playing time of a sporting event, in particular of the basketball match type or another team sport, the portable system being intended to be carried by a referee of the sporting event and comprising:

- acoustic sensor, in particular of the microphone type, designed to measure the external acoustic signals and deliver raw analog measure signals in response to the measure of the external acoustic signals;
- analog/digital converter connected to the acoustic sensor and designed to convert the raw analog measuring signals into digital measuring signals;
- digital processor, in particular of the digital signal processor type, connected to the analog/digital converter and designed to process and analyze the digital measuring signals so as to detect the transmission or non-transmission of the refereeing acoustic signal among the external acoustic signals measured by said acoustic sensor, said digital processor delivering a digital refereeing signal in response to the detection of the acoustic refereeing signal; and
- transmitter connected to the digital processor and designed to transmit said digital refereeing signal.

Thus, with this portable system, the detection of the acoustic refereeing signal is done directly in the system carried by the referee, and this detection is done without any analog processing on the raw analog measuring signals, with the possible exception of an amplification, but is done using a transparent digital processing that does not color or deform the raw analog measuring signals.

In this way, the detection of the acoustic refereeing signal, hereinafter called the whistle, is done before radio transmission intended for the fixed system (explained later) of the scoreboard. Thus, owing to the invention, there is no risk of distortion and/or coloring of the signals during radio communication towards the scoreboard, the detection of the whistle occurring before the radio communication intended for the fixed system. It is of course possible for this acoustic refereeing signal to be transmitted by types of sound warning systems other than whistles, such as a horn, for example.

In one particular embodiment, the refereeing signal only serves to signal the stoppage of the playing time, and the restarting or resumption of the playing time is signaled in another way, for example vocally or manually.

Following the detection of the whistle by the digital processor, the system transmits a simple digital refereeing signal intended for the fixed system; such a digital refereeing system, which informs the detection of the acoustic arbitration system, being markedly less sensitive to the electromagnetic disruptions caused by external electronic devices. Thus, according to the invention, the radio connection between the portable system and the fixed system is a digital radio connection that has a number of advantages, such as the possibilities of transmitted the digital refereeing signal several times for safety, verifying the integrity of the radio digital connection, guaranteeing the information transmitted by this digital radio connection, etc.

Moreover, the digital processor make it possible to perform a particularly reliable detection of the whistle, not limited to a simple frequency analysis, which advantageously makes it possible to avoid incorrect detections by confusing the whistle with external acoustic signals having a frequency component of the same nature, such as for example whistles belonging to the general public, the screeching of shoe soles on the ground, etc. Indeed, this digital processor makes it possible to place the detection of the whistle on other parameters representative of the whistle, but not representative of these external acoustic signals.

According to one characteristic, the digital processor comprises a comparing element for comparing the amplitude of the digital measuring signals with a reference amplitude, in order to detect a signal with a high acoustic power (also called sound power) when the amplitude of the digital measuring signals is greater than the reference amplitude.

Thus, the detection of the whistle can be done by analyzing the amplitude or the acoustic power, because a whistle generally assumes the form of an acoustic signal with a strong acoustic power, where the ambient noise and surrounding voices (voices of the players, coaches, referees, spectators, etc.) are more moderate.

According to another feature, the digital processor comprises a comparing element for comparing the temporal profile of the amplitude envelope of the digital measuring signals with a temporal profile of a reference envelope, in order to detect a signal having a temporal profile of the acoustic power envelope that substantially corresponds to the temporal profile of the reference envelope.

Thus, the detection of the whistle can be done by analyzing the temporal profile of the amplitude envelope of the digital measuring signals, because a whistle generally has a fairly specific envelope profile, traditionally with an abrupt acoustic power rise followed by a power plateau, then finally a slow decrease of the acoustic power. The analysis of this envelope profile is particularly advantageous to distinguish the whistle from the aforementioned surrounding voices, ambient noise and external acoustic signals having a frequency component of the same nature. This reference envelope profile thus forms a sort of signature of the whistle that reinforces the reliability of the detection of this whistle.

Advantageously, the temporal profile of the reference envelope is defined by the following parameters:

an increase in the acoustic power of a first predetermined power value, in particular in the vicinity of 30 to 40 dB, in relation to a base power associated with an ambient noise background, over a first period of time, in particular in the vicinity of a few milliseconds;

a plateau of the acoustic power over a second time period, in particular of around 50 milliseconds, following the first time period and where the second time period is longer than the first time period, this plateau possibly having an increase of the acoustic power by a second predetermined power value, in particular in the vicinity of 5 to 6 dB, over the second time period, the second power value being less than the first power value; and a decrease in the acoustic power until it reaches substantially the base power, over a third time period, in particular in the vicinity of 200 to 400 milliseconds, following the second time period, where the third time period is longer than the second time period.

Such a reference envelope is advantageous in regard to the envelope profiles traditionally observed with an abrupt power increase followed by a power plateau and, ultimately, a slow decrease of the power.

Preferably, the digital processor comprises means for modification of the reference envelope, in order in particular to take the presence of an echo in a gymnasium into account.

Thus, it is possible to take into account the interior architecture of a gymnasium responsible for an echo in the detection of the whistle. Indeed, the presence of an echo tends to noticeably elongate the envelope and slightly modulate its response. In this case, the reference envelope is modified so that it corresponds to the exact signature of the whistle in that specific environment. This modification can be made beforehand with several tests of whistles in the silent gymnasium.

According to another feature, the digital processor comprises a comparing element for comparing the frequencies of the digital measuring signals with a reference frequency range, in order to detect a signal transmitted in said reference frequency range.

Thus, the detection of the whistle can be done by analyzing the frequency of the digital measuring signals, because a whistle is transmitted in a specific acute frequency range.

Advantageously, the digital processor is designed to implement, successively:

the comparing element for comparing the amplitude of the digital measuring signals with a reference amplitude; then the comparing element for comparing the temporal profile of the amplitude envelope of the digital measuring signals with a temporal profile of a reference envelope; and lastly the comparing element for comparing the frequencies of the digital measuring signals with a reference frequency range.

In this embodiment, the detection is done in three successive phases:

a first phase for comparing the amplitude of the digital measuring signals with a reference amplitude, making it possible to detect the signals with a high acoustic power, the acoustic power being very characteristic of the whistle, this first phase makes it possible to avoid implementing the other phases if no sufficiently powerful sound is detected;

a second phase for comparing the temporal profile of the amplitude envelope of the digital measuring signals with a temporal profile of a reference envelope, this envelope profile constituting a very specific signature of the whistle, such that this second phase guarantees the detection of the whistle; and a third phase for comparing frequencies of the digital measuring signals with a reference frequency range, in order to ultimately confirm the detection of the whistle.

The succession of these three phases guarantees the detection of the whistle practically 100%, and also guarantees that no other external acoustic sound signal will be confused with the whistle, thereby avoiding incorrect triggering of the stoppage of playing time.

The various reference parameters (reference amplitude, reference envelope and reference frequency range) are to be brought closer to those of the referenced whistles; as a reminder, the whistles are generally approved and referenced by the federations in charge of these sporting events or by any other sworn body for these sporting events. Thus, the portable system includes an internal memory in which these reference parameters are stored, preferably with the possibility of modifying and/or replacing them to be able to adapt this portable system to several types of whistles and/or the presence of an echo as described above.

According to another advantageous feature of the invention:

the digital processor is designed to process and analyze the digital measuring signals so as to detect, among the acoustic signals measured by said acoustic sensor, a specific vocal order emitted by the referee to signal the resumption of the playing time, said digital processor delivering a digital signal for restarting the playing time in response to the detection of said vocal order; and the transmitter is designed to transmit said digital signal for restarting the playing time.

Once the playing time countdown has been stopped after the detection of an acoustic refereeing signal signaling the stoppage of the playing time, this feature makes it possible to vocally and automatically restart the playing time countdown, by using the same communication channel as for the digital refereeing signal, i.e. the aforementioned digital wireless connection that has all of the advantages already described.

According to one possibility of the invention, the system also comprises a manual actuator for manually actuating the resumption of the playing time, in particular of the switch or numeric keypad key type, intended to be manually actuated by the referee to signal the resumption of the playing time; and furthermore the digital processor are connected to said manual actuator, said digital processor delivering a digital signal for restarting the playing time in response to the actuation of the manual actuator by the referee; and the transmitter is designed to transmit said digital signal for restarting the playing time.

Once the playing time countdown has been stopped after the detection of an acoustic refereeing signal signaling the stoppage of the playing time, this feature makes it possible to manually and automatically restart the playing time countdown, by using the same communication channel as for the digital refereeing signal, i.e. the aforementioned digital wireless connection that has all of the advantages already described.

According to another possibility of the invention, the system also comprises an amplifier positioned at the output of the acoustic sensor to amplify the raw analog measuring signals before being converted by the analog/digital converter.

This amplifier aims to perform a simple amplification of raw analog measuring signals, without other analog processing, so as not to color them.

According to another possibility of the invention, the transmitter is designed to transmit the digital arbitration signal several times, in particular at regular time slots preferably in the vicinity of 10 to 50 milliseconds, over a predetermined time period.

In this way, and owing to the digital radio connection, the digital refereeing signal, which will serve to trigger the stoppage and/or resumption of the playing time in the fixed system (as described later), can be transmitted several times to be certain that the latter is indeed received by the fixed system.

Thus, out of three consecutive transmissions of the digital refereeing signal, it is admissible to "lose" one or two transmissions, in other words not to receive one or two transmissions at the fixed system of the scoreboard. Indeed, in losing two out of three transmissions, the fixed system still receives the digital refereeing signal at most within a maximum period of 30 to 150 milliseconds following its transmission, which is completely acceptable for managing the time of a sporting event and remains below the maximum allowable delay to stop the playing time countdown.

In the radiocommunications field, it is traditional to perform a transmission at regular time slots in the vicinity of 10 to 30 milliseconds, such that it can still be considered to have 80% loss in the transmission, thereby offering great flexibility in the conveyance of the digital signals via the digital wireless connection.

Advantageously, the transmitter is configured to transmit several digital signals on a same frequency channel called communication channel, according to a temporal multiplexing communication method allowing data transmission in successive cycles of the same communication channel, each cycle being divided into a plurality of time slots, and each cycle has a time slot reserved for the transmission of the digital refereeing signal. Of course, the choice of time slot can possibly change from one cycle to the next, depending for example on priority considerations for conveying data.

This type of communication thus makes it possible to use the communication channel, in other words the aforementioned digital radio connection, to transmit several types of digital data and not just the digital refereeing signal, such as for example audio-digital data allowing wireless, multi-user audio communication, with temporal multiplexing in a single channel. The digital data is thus distributed in the form of data packets transmitted in the time slots of successive cycles. It is understood, within the meaning of the present application, that a "cycle" constitutes a cycle of a communication or transmission channel, said "cycle" sometimes wrongly being called a "frame."

In one particular embodiment, each cycle has a time slot reserved for the transmission of the digital signal for restarting the playing time defined above, in order to take advantage of this communication channel to transmit this digital signal for restarting the playing time.

Advantageously, the transmitter is configured to integrate, into one of the time slots of each cycle, a cyclical redundancy signal that makes it possible to verify the integrity of the transmitted cycles.

Thus, the cycles (or frames) integrate a cyclical redundancy code that makes it possible to verify the proper integrity of the cycles, such that:

- either the cycle is entirely intact and its content is then most certainly valid, and in particular the digital refereeing signal;
- or the cycle is corrupt and is then ignored in its entirety, including the digital refereeing signal, such that incorrect triggering due to disruptions in the digital radio connection (essentially very rare) are excluded.

The invention also concerns an audio-digital communication terminal by temporal multiplexing allowing a transmission of audiometric data in the successive cycles of a same communication channel, each cycle being divided into a plurality of time slots, comprising:

- audio or voice transceiver, also called audio communication means, allowing the reception and transmission of the voice, in particular comprising a microphone and a loudspeaker;
- audio-digital converter in connection with the audio transceiver in order to convert the voice into audiometric data, and vice versa;
- controller, in particular of the microprocessor type, in connection with the audio-digital converter and designed to receive, as input, the audiometric data and deliver it as output in the time slots of the cycles of the communication channel, and vice versa; and
- radio transmitter/receiver adapted to receive and transmit audiometric data in the successive cycles of the same communication channel; and
- a portable acquisition and detection system according to the invention, said portable acquisition and detection system being integrated into said audio-digital communication terminal with:
  - its acoustic sensor, which is integrated into the audio transceiver;
  - its analog/digital converter, which is integrated into the audio-digital converter;
  - its digital processor, which is integrated into the controller; and with
  - its transmitter, which is integrated into the radio transmitter/receiver, each cycle of the communication channel having a time slot reserved for the transmission of the digital refereeing signal.

The invention also concerns a fixed system for controlling the playing time of a sporting event, in particular of the basketball type or another team sport, said fixed system being intended to be in radio communication with at least one portable acquisition and detection system according to the invention, and including:

- receiver in radio connection with the transmitter of the or each portable acquisition and detection system, said receiver being designed to receive the or each digital refereeing signal;
- controller connected to the receiver and designed to deliver a control refereeing signal in response to the reception of a digital refereeing signal by the receiver; and
- time measuring instrument for counting down the playing time, in particular of the stopwatch or chronometer type, connected to the controller and configured to stop and/or resume the countdown of the playing time in response to the delivery of the control refereeing signal.

This fixed system is thus particularly adapted to the portable system described above, according to an obvious technical connection of the transmitter/receiver type. Indeed, this fixed system does not include any means for analysis or processing of the digital refereeing signal, the detection of the whistle having already been done in the portable system.

This fixed system receives the digital refereeing system, which serves to trigger the stoppage of the playing time countdown via the controller; this system of course being adapted to receive the digital refereeing signal and, if applicable, distinguish it from other digital data in the context of a communication by temporal multiplexing.

According to one advantageous feature of the invention:

the receiver is designed to receive the or each digital signal for resuming the playing time defined above;

the controller is designed to generate a restarting control signal in response to the receipt of a digital signal for restarting the playing time by the receiver; and the time measuring instrument is configured to start or restart the countdown of the playing time in response to the delivery of the restarting control signal.

The invention also concerns a control installation of the playing time of a sporting event, in particular of the basketball game type or other team sport, said installation including:

at least one portable acquisition and detection system according to the invention; and a fixed system for controlling the playing time according to the invention and in radio connection with the or each portable acquisition or detection system.

The present invention also concerns a control installation of the playing time of a sporting event, in particular of the basketball game type or other team sport, said installation including:

several audio-digital communication terminals intended to be carried by the referees for the sporting event to allow audio communication between said referees, where at least one of said communication terminals is in accordance with the invention integrating a portable system according to the invention; and a fixed system for controlling the playing time according to the invention and in radio connection with the or each portable acquisition or detection system equipping the audio-digital communication terminals.

BRIEF DESCRIPTION OF THE DRAWINGS

Other features and advantages of the present invention will appear upon reading the detailed description that follows, of one non-limiting embodiment, done in reference to the appended figures, in which.

Figure 1:
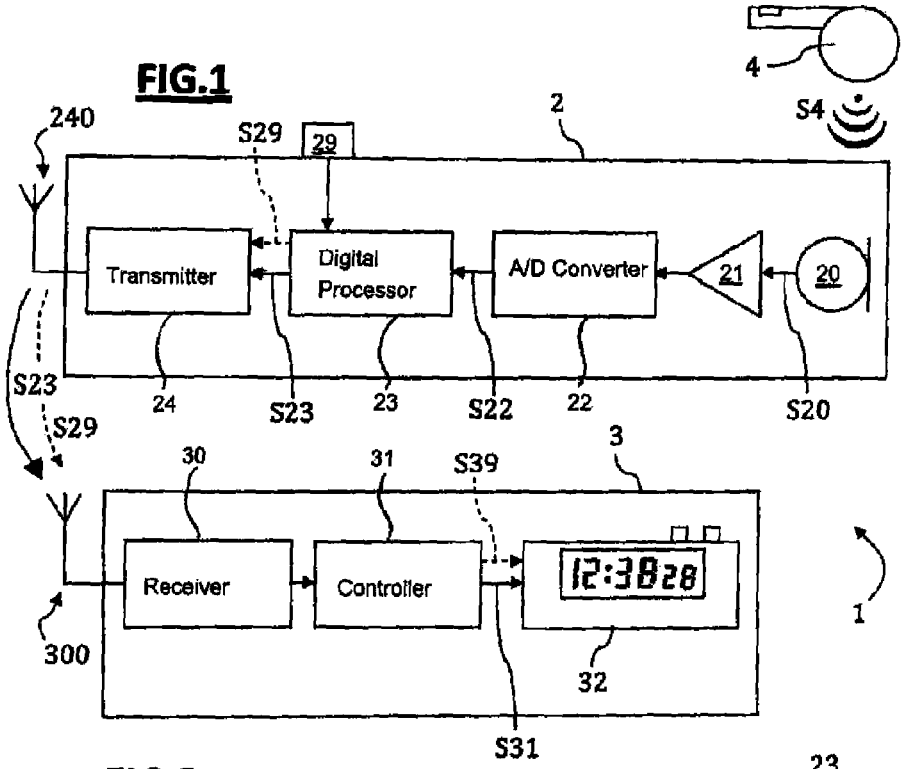
FIG. 1 is a diagrammatic view of a control installation of the playing time of a sporting event according to the invention, comprising a portable acquisition and detection system and a fixed control system of the playing time of the sporting event both according to the invention.

In reference to FIG. 1, an installation 1 for controlling the playing time of a sporting event, such as for example a basketball game, according to the invention includes:

at least one portable acquisition and detection system 2, intended to be carried by a referee of the sporting event; and a fixed system 3 for controlling the playing time in radio connection with the or each portable system 2 and intended to be positioned on a scoreboard, for example.

DETAILED DESCRIPTION

The portable system 2 is designed for the acquisition and detection of a so-called refereeing acoustic signal S4 signaling a stoppage and/or resumption of the playing time of a sporting event. This refereeing acoustic signal S4 can be emitted by the referee or one of the referees of the sporting event, using a whistle 4, and there is then a whistle S4 signaling the stoppage of the playing time, or the resumption of the playing time.

For the rest of the description, the refereeing acoustic signal will be considered to be a whistle S4 that signals only the stoppage of the playing time, with the understanding that other types of acoustic signal can be considered.

This portable system 2 comprises an acoustic sensor 20, for example of the microphone type, designed to:

measure the external acoustic signals from all acoustic sources present during the sporting event (public, referees, players, coaches, whistles, commentators, advertisements, screeching of shoe soles, etc.) including the whistle S4 from the referee's or referees' whistle 4; and to deliver raw analog measuring signals S20 in response to the measuring of the external acoustic signals.

This portable system 2 comprises, as output of the acoustic sensor 20, an amplifier 21 designed to amplify the raw analog measuring signals S20.

This portable system 2 comprises, as output of the amplifier 21, an analog/digital converter 22 designed to convert the raw analog measuring signals S20, amplified beforehand by the amplifier 21, into digital measuring signals S22, also called "Audio" audiometric data in the case of an integration of the portable system 2 into a communication terminal 8 as described below.

Thus, the raw analog measuring signals S20 are immediately sampled so as to digitize them; no analog processing is done on these signals, such as filtering or compression processing, aside from a simple amplification, transparent, so as not to color them.

Next, this portable system 2 comprises, as output of the analog/digital converter 22, digital processor 23, for example of the digital signal processor type, designed to process and analyze the digital measuring signals S22 in order to detect the transmission or non-transmission of the whistle S4 among the other external acoustic signals measured by the acoustic sensor 20. This digital processor 23 delivers a digital refereeing signal S23 of the playing time in response to the detection of the whistle S4; this digital refereeing signal S23 thus forms a digital signal indicating the detection of the whistle and designed to order the stoppage of the playing time countdown.

Lastly, this portable system 2 comprises a transmitter 24 connected to the digital processor 23 and designed to transmit said digital refereeing signal S23, via an antenna 240.

Figure 2:
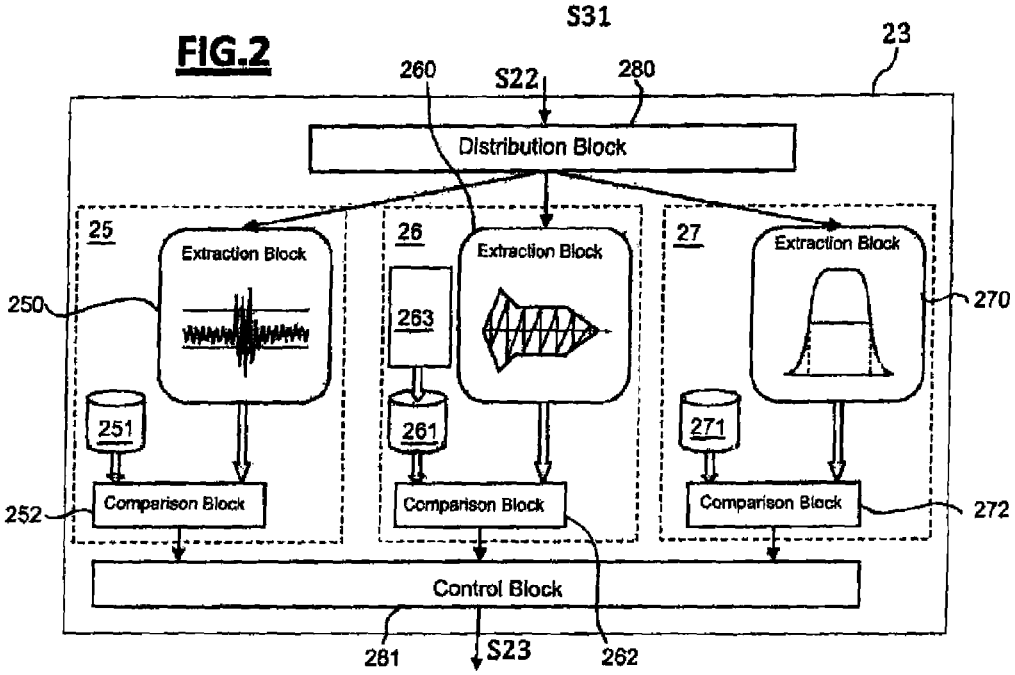
FIG. 2 is a diagrammatic view of the digital processor of a portable acquisition and detection system according to the invention.

In reference to FIG. 2, to conduct the analysis, the digital processor 23 comprises three distinct comparing elements:

a first comparing element 25 for comparing the amplitude of the digital measuring signals S22 with a reference amplitude, in order to detect a signal with a high acoustic power when the amplitude of the digital measuring signals is greater than the reference amplitude;

a second comparing element 26 for comparing the temporal profile of the amplitude envelope of the digital measuring signals S22 with a temporal profile of a reference envelope, in order to detect a signal having a temporal profile of the acoustic power envelope that substantially corresponds to the temporal profile of the reference envelope;

a third comparing element 27 for comparing the frequencies of the digital measuring signals S22 with a reference frequency range, in order to detect a signal transmitted in said reference frequency range.

The digital processor 23 comprises, as input, a distribution block 280 of the digital measuring signals S22 in the three comparing elements 25, 26, 27.

The first comparing element 25, called first comparison block, comprises an extraction block 250 for extracting the amplitude of the digital measuring signals S22, a memory block 251 in which the reference amplitude is stored, and a comparison block 252 between the amplitude of the digital measuring signals S22 and the reference amplitude.

The second comparing element 26, called second comparison block, comprises an extraction block 260 for extracting the temporal profile of the amplitude envelope of the digital measuring signals S22, a memory block 261 in which the reference envelope is stored, and a comparison block 262 between the temporal profiles of the amplitude envelopes of the digital measuring signals S22 and reference signals.

The temporal profile of the reference envelope is defined by the following parameters:

an increase in the acoustic power of a first predetermined power value, in particular in the vicinity of 30 to 40 dB, in relation to a base power associated with an ambient noise background, over a first period of time, in particular in the vicinity of a few milliseconds;

a plateau of the acoustic power over a second time period, in particular of around 50 milliseconds, following the first time period and where the second time period is longer than the first time period, this plateau possibly having an increase of the acoustic power by a second predetermined power value, in particular in the vicinity of 5 to 6 dB, over the second time period, the second power value being less than the first power value; and a decrease in the acoustic power until it reaches substantially the base power, over a third time period, in particular in the vicinity of 200 to 400 milliseconds, following the second time period, where the third time period is longer than the second time period.

To take the presence of an echo into account, the second comparing element 26 comprises a parameterization means 263 of the temporal profile of the reference envelope stored in the memory block 261. In this way, the processing also takes into account the possibility of an echo in the gymnasium that will noticeably elongate the temporal profile and slightly modulate its response.

The third comparing element 27, called third comparison block, comprises an extraction block 270 for extracting frequencies of the digital measuring signals S22, a memory block 271 in which the reference frequency range is stored, and a comparison block 272 between the frequencies of the digital measuring signals S22 and the reference frequency range.

The digital processor 23 is designed to successively implement the first comparing element 25, then the second comparing element 26 and lastly the third comparing element 27.

Thus, the processing means implemented to carry out the detection of the whistle S4 includes the following three successive phases:

temporal detection of a high acoustic power signal, where the ambient noise or referee's voice is more moderate, in light of the acoustic sensor 20, using the first comparison block 25;

temporal detection of the envelope of the whistle S4 that for example has a very sharp acoustic power rise, then a practically fixed acoustic power, followed by a slow decrease of the acoustic power (this profile being very distinct from the ambient vocal signals and the ambient noise), using the second comparison block 26; and frequency analysis of the whistle S4 to ensure the temporal tests, for example detection of the treble dominant, using the third comparison block 27.

The digital processor 23 lastly includes a control block 281 that analyzes the results of the different comparisons done in the three comparison blocks 26, 27, 28 and, as a function of those results, does or does not deliver the refereeing digital signal S23.

The fixed system 3 includes:

a receiver 30 in radio connection with the transmitter 24 of the or each portable system 2, via an antenna 300, said receiver being designed to receive the or each digital refereeing signal S23;

a controller 31 connected to the receiver 30 and designed to deliver a control refereeing signal S31 in response to the reception of a digital refereeing signal S23 by the receiver 30; and a time measuring instrument 32 for counting down the playing time, in particular of the stopwatch or chronometer type, connected to the controller 31 and configured to stop (and/or resume if applicable) the countdown of the playing time in response to the delivery of the control refereeing signal S23.

Thus, once the digital refereeing signal S23 is present at the scoreboard, the stoppage (and/or resumption, if applicable) operation of the playing time countdown becomes a simple electrical action equivalent to pressing on the stop button of the stopwatch. In the present case, the receiver 30 and the controller 31 together only form one remote control system that in no way participates in the action of detecting the whistle S4.

The detection of a whistle S4 is a mechanism similar to that used by the extraction processing of the voice in the sound. Because of this, the detection of the whistle can be an accessory of an audio-digital communication terminal 8, integrating the portable system 2 in this type of communication terminal 8, or made up of a completely separate autonomous system, with the independent portable system 2.

Figures 3, 4A, 4B, 5:
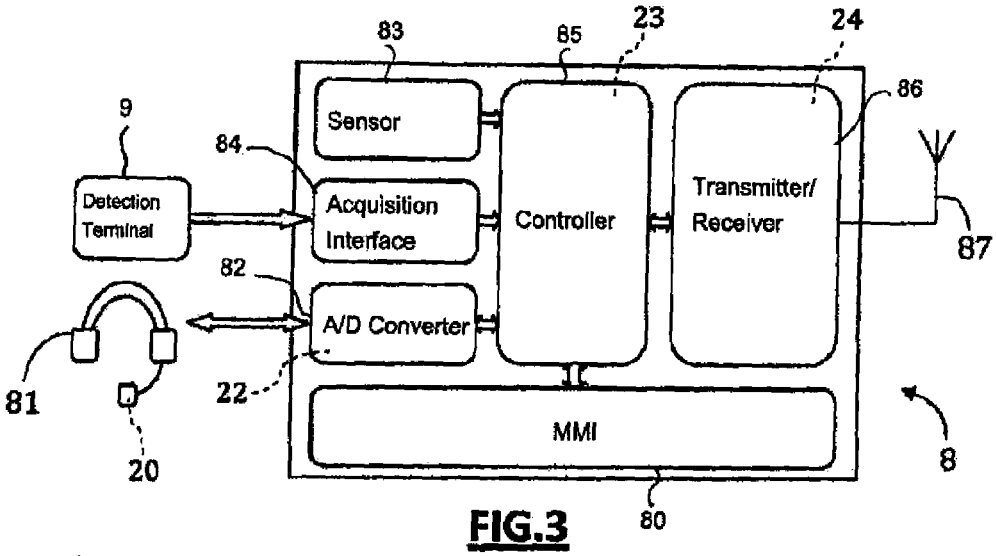
FIG. 3 is a diagrammatic view of an audio-digital communication terminal according to the invention, integrating a portable acquisition and detection system according to the invention.
FIGS. 4*a* and 4*b* are diagrammatic views of two successive cycles (or frames) of a communication channel used for the radio transmission of the digital refereeing signal between the portable system and the fixed signal.
FIG. 5 is a diagrammatic view of a mixed data packet grouping together several categories of data, including the digital refereeing signal.

In reference to FIG. 3, this portable system 2 can therefore be integrated into an audio-digital communication terminal 8 by temporal multiplexing allowing a transmission of audiometric data in the successive cycles 5 of a same communication channel, each cycle 5 being divided into a plurality of time slots TS1 to TS6, as shown in FIGS. 4*a* and 4*b*.

In this case, the installation 1 can comprise several communication terminals 8 where at least one of these communication terminals 8 integrates a portable system 2, each communication terminal 8 being intended to be carried by a referee for the sporting event to enable audio communication between the referees, and the fixed system 3 is in radio connection with the or each portable system 2.

Time division multiple access methods are commonly used, in particular in mobile telephony. Time division multiple access (TDMA) is a temporal multiplexing mode making it possible to transmit several digital signals over a same frequency channel. Thus, several users, here the referees, share the same channel. The data flow is divided into data packets 6 and transmitted in a communication channel divided into 5 successive periodic channels.

FIG. 3 illustrates such a communication terminal 8 comprising:

- a man-machine interface 80, or MMI, in particular allowing the referee to transmit command orders or data, such a man-machine interface 80 being produced for example in the form of a keyboard, numeric keypad, touch screen, or similar;
- an audio or voice transceiver 81 allowing the reception and transmission of the voice and other audio sounds, including the whistle S4, comprising in particular a microphone and a loudspeaker, such audio transceiver being able to be produced in the form of a communication headset or an earpiece of the mobile telephony type;
- an audio-digital converter 82, in particular of the audio-digital interface type, connected with the audio transceiver 81 in order to convert the sounds, including the voice and the whistle S4, into audiometric data "Audio" comprising, among others, the voice data "voice," and vice versa to convert audiometric data from the controller into sounds for the audio transceiver;
- possibly one or several onboard sensors 83 designed to measure a local parameter, for example such as an accelerometer or a temperature sensor, and convert it into a measured value "Mes";
- possibly an acquisition interface 84 in connection with one or several external detection terminals 9 designed to measure an external parameter that can influence the sporting event in progress, for example such as a device measuring the wind and/or sun, and convert it into a measured value "Mes."

The communication terminal 8 also comprises a controller 85, in particular of the communication microprocessor or processor type, in connection with the audio-digital converter 82, and if applicable with the onboard sensors 83 and the acquisition interface 84, designed to:

- receive, as input, the audiometric data "Audio" and possibly the measured values "Mes";
- digitally process said data so as to extract the vocal data "voice" from the ambient noise (in particular using voice recognition software); and to
- deliver, as output, the voice data "voice" and possibly measured values "Mes" in time slots of the cycles 5 of the communication channel according to a communication method through temporal multiplexing between several communication terminals, and vice versa.

The communication terminal 8 lastly comprises a radio transmitter/receiver 86, in particular of the radio-digital transceiver type, in connection with the controller 85 and adapted to receive and transmit the voice data "voice" and possibly measured values "Mes" in the successive cycles 5 of the same communication channel, via an antenna 87.

The portable system 2 is thus integrated into this audio-digital communication terminal 8 with:

- its acoustic sensor 20, which is integrated into the audio or voice transceiver 81,
- its analog/digital converter 22, which is integrated into the audio-digital converter 82;
- its digital processor 23, which is integrated into the controller 85; and with
- its transmitter 24, which is integrated into the radio transmitter/receiver 86, each cycle 5 of the communication channel having a time slot reserved for the transmission of the digital refereeing signal S23.

In this way, the controller 85 delivers, as output, the digital refereeing signal S23, following the detection of the whistle S4 by the digital processor 23 integrated into said controller 85, by integrating this digital arbitration signal S23 into a time slot TS5 of one or several cycles 5 of the communication channel according to a communication method by temporal multiplexing, as illustrated in FIG. 4*a*.

Thus, once the whistle is detected S4, the digital refereeing signal S23 is transmitted, for example in the form of a bit activated by the digital processor 23. Then this digital refereeing signal S23 is integrated into the digital cycles (or frames) periodically transmitted, and which can ensure the transport of audio-digital voice data. This process only takes a few microseconds and therefore has no delay effect for stopping the playing time countdown.

In reference to FIG. 4*a*, an example of a communication cycle 5 in which:

- a first communication terminal 8 carried by a first referee, provided with an integrated sensor 83, communicates vocal audio-digital data "Voice," a first measured value Mes1 and a synchronization signal Sync in the time slot TS1 of cycle 5;
- a detection terminal 9 communicates a second measured value Mes2 in time slot TS2;
- a second communication terminal 8 carried by a second referee communicates voice audio-digital data "Voice" in time slot TS4;
- one of the two communication terminals 8 communicates the digital refereeing signal S23, in this case the communication terminal 8 carried by the referee originating the whistle.

As shown in FIG. 4*b*, the fixed system 3 can communicate reception data AR (or a return receipt signal) in the cycle 5 following the cycle 5 mentioned above and shown in FIG. 4*a*, in order to acknowledge receipt of the digital refereeing signal S23, and possibly to signify the actuation or non-actuation of the stoppage of the playing time countdown. In this case, the fixed system 3 also comprises a transmitter, and its controller 31 is designed to deliver a return receipt signal in response to the stoppage of the stopwatch 32.

As illustrated in FIG. 5, the transmission time for each user is therefore divided into vocal audio-digital data "Voice," the digital refereeing signal S23 and, if applicable, measured values "Mes," in this case a first measured value Mes1 and a second measure value Mes2, combined within a data packet 6 brought together in a mixed data frame. The nature of the header of the data packet 6 can for example determine the format and content of the packet (number of measured values, presence or absence of audio-digital data, measured values, dimension of the packets, etc.), before closing the packet by a postambule or trailer "CRC+EOF." The digital arbitration signal S23 can correspond to a unique detection bit, this unique bit assuming the value 1 in case of detection of the whistle S4, and the value 0 in the absence of detection of the whistle S4.

In a digital communication installation, the notion of real time is essential, thus the cycles 5 are transmitted very regularly, for example every 10 to 30 milliseconds. This regularity makes it possible in particular to verify the proper operation and the availability of the portable 2 and fixed 3 systems of the installation 1. Thus, the transmitter 24, and more generally the radio transmitter/receiver 86, is designed to transmit the digital refereeing signal S23 several times with a regular time deviation in the vicinity of 10 to 30 milliseconds, over a predetermined period of time.

Given this chronology of the exchanges, the digital refereeing signal S23 is conveyed in 10 to 30 milliseconds to the fixed system 3 of the scoreboard, or even double or triple if several cycles 5 are lost. For example, if several cycles 5 are lost, then the digital refereeing signal S23 is conveyed in 20-60 milliseconds (double time) or in 30-90 milliseconds time) to the fixed system 3 of the scoreboard. These delays in any case remain well below the maximum allowable delay for stopping the playing time countdown.

The digital refereeing signal S23, forming the detection information of the whistle S4, can thus be transmitted for several seconds in order to ensure its transport. If applicable, the digital arbitration signal S23 can be fulfilled by a return, of the return receipt signal AR type, generated by the fixed system 3 once the playing time countdown is stopped.

Moreover, the transmitter 24, and more generally the radio transmitter/receiver 86, is configured to integrate, into one of the time slots of each cycle 5, a cyclical redundancy signal that makes it possible to verify the integrity of the transmitted cycles, such that:

if the cyclical redundancy signal is valid, then the cycle (or frame) is integrated and its content is then most certainly valid, and in particular the digital refereeing signal S23;

if the cyclical redundancy signal is not valid, then the cycle is corrupt and is then ignored in its entirety, including the digital refereeing signal S23.

If a too large number of cycles is missing or degraded, for example more than 30% of the cycles, it is possible to indicate the malfunction to the operator or to proceed with measures to reduce the error, such as, for example, increasing radio powers, changing radio channels, etc.

Just like the whistle S4 is detected to stop the playing time countdown, it is possible to restart this same playing time countdown upon an action by the referee.

A first possibility for restarting the playing time countdown is to provide detection of a vocal order from the referee, for example such as a keyword of the "Start" or "Chrono" type. In this case, this portable system 2 is designed such that:

its digital processor 23 processes and analyzes the digital acoustic measuring signals so as to detect, among the acoustic signals measured by the acoustic sensor 20, a specific vocal order emitted by the referee to signal the resumption of the playing time, said digital processor 23 delivering a digital signal S29 for restarting the playing time in response to the detection of said vocal order; and its transmitter 24 is designed to transmit said digital signal S29 for restarting the playing time.

This first possibility is particularly well adapted to the case where the portable system 2 is integrated into a communication terminal 8.

As illustrated in FIG. 1, a second possibility for restarting the playing time countdown is to provide a manual detection of an action by the referee, for example pressure on a button or switch. In this case, the portable system 2 also comprises a manual actuator 29 for manually actuating the resumption of the playing time, in particular of the switch or numeric keypad type, intended to be manually actuated by the referee to signal the resumption of the playing time, as illustrated in FIG. 1. Moreover, the digital processor 23 is connected to said manual actuator 29, said digital processor 23 delivering a digital signal S29 for restarting the playing time in response to the actuation of the manual actuator 29 by the referee. Lastly, the transmitter 24 is designed to transmit said digital signal for restarting the playing time.

These two possibilities for restarting the playing time countdown can be considered alone or in combination, and should be considered in the case where the whistle S4 serves only to trigger the stoppage of the playing time. As illustrated in FIG. 1, in both possibilities, the fixed system 3 is designed such that:

the receiver 30 is designed to receive the or each digital signal for resuming the playing time S29;

the controller 31 is designed to generate a restarting control signal S39 in response to the receipt of a digital signal S29 for restarting the playing time by the receiver 30; and the time measuring instrument 32 is configured to start or restart the countdown of the playing time in response to the delivery of the restarting control signal S39.

In both possibilities, this action to restart the playing time countdown uses the same digital radio communication channel upon the detection of the whistle S4 and stoppage of the playing time countdown. Thus, each cycle 5 of the communication channel can have a time interval reserved for the transmission of this digital signal for restarting the playing time S29.

Of course, the embodiment mentioned above is in no way limiting and other details and improvements can be made to the installation and the systems according to the invention, without going beyond the scope of the invention where other elements can for example be integrated into the installation.

The invention claimed is:

1. A portable system for acquisition and detection of a refereeing acoustic signal signaling a stop and/or resumption of playing time of a sporting event, the portable system comprising:

an acoustic sensor designed to measure external acoustic signals and deliver raw analog measuring signals in response to the measure of the external acoustic signals;

an analog/digital converter connected to the acoustic sensor and designed to convert the raw analog measuring signals into digital measuring signals;

a digital processor connected to the analog/digital converter and designed to process and analyze the digital measuring signals so as to detect transmission or non-transmission of the refereeing acoustic signal among the external acoustic signals measured by said acoustic sensor, said digital processor delivering to a transmitter a digital refereeing signal in response to the detection of the refereeing acoustic signal; and the transmitter connected to the digital processor and designed to transmit said digital refereeing signal;

wherein the digital processor is designed to process and analyze the digital measuring signals so as to detect, among the acoustic signals measured by said acoustic sensor, a specific vocal order emitted by the referee to signal the resumption of the playing time, said digital processor delivering to the transmitter a digital signal for restarting the playing time in response to the detection of said vocal order; and the transmitter is designed to transmit said digital signal for restarting the playing time.

2. The portable acquisition and detection system according to claim 1, wherein the digital processor comprises a comparing element for comparing an amplitude of the digital measuring signals with a reference amplitude, in order to detect a digital measuring signal with a high acoustic power when the amplitude of the digital measuring signals is greater than the reference amplitude.

3. The portable acquisition and detection system according to claim 1, wherein the digital processor comprises a comparing element for comparing a temporal profile of an amplitude envelope of the digital measuring signals with a temporal profile of a reference envelope, in order to detect a signal having a temporal profile of the amplitude envelope that substantially corresponds to the temporal profile of the reference envelope.

4. The portable acquisition and detection system according to claim 3, wherein the digital processor comprises means for modification of a temporal profile of the reference envelope, in order to take a presence of an echo in a gymnasium where the sporting event occurs into account.

5. The portable acquisition and detection system according to claim 1, wherein the temporal profile of the reference envelope is defined by the following parameters:

an increase in acoustic power of a first predetermined power value in relation to a base power associated with an ambient noise background, over a first period of time;

a plateau of the acoustic power over a second time period, following the first time period and where the second time period is longer than the first time period; and a decrease in the acoustic power until it reaches substantially the base power, over a third time period following the second time period, where the third time period is longer than the second time period.

6. The portable acquisition and detection system according to claim 1, wherein the digital processor comprises a comparing element for comparing frequencies of the digital measuring signals with a reference frequency range, in order to detect a digital measuring signal emitted in said reference frequency range.

7. The portable acquisition and detection system according to claim 1, wherein the digital processor is designed to successively implement:

a first comparing element for comparing an amplitude of the digital measuring signals with a reference amplitude, in order to detect a digital measuring signal with a high acoustic power when the amplitude of the digital measuring signals is greater than the reference amplitude; then a second comparing element for comparing a temporal profile of an amplitude envelope of the digital measuring signals with a temporal profile of a reference envelope, in order to detect a digital measuring signal having a temporal profile of the acoustic power envelope that substantially corresponds to the temporal profile of the reference envelope; and lastly a third comparing element for comparing frequencies of the digital measuring signals with a reference frequency range, in order to detect a digital measuring signal emitted in said reference frequency range.

8. The portable acquisition and detection system according to claim 1, further comprising a manual actuator for manually actuating resumption of the playing time, intended to be manually actuated by the referee to signal the resumption of the playing time; and wherein the digital processor is connected to said manual actuator, said digital processor delivering said digital signal for restarting the playing time in response to the actuation of the manual actuator by the referee; and the transmitter is designed to transmit said digital signal for restarting the playing time.

9. The portable acquisition and detection system according to claim 1, further comprising an amplifier positioned at an output of the acoustic sensor to amplify the raw analog measuring signals before being converted by the analog/digital converter.

10. The portable acquisition and detection system according to claim 1, wherein the transmitter is designed to transmit the digital refereeing signal several times at regular time slots over a predetermined period of time.

11. The portable acquisition and detection system according to claim 10, wherein each cycle has a time slot reserved for said digital signal for restarting the playing time.

12. The portable acquisition and detection system according to claim 10, wherein the transmitter is configured to integrate, in one of the time slots of each cycle, a cyclical redundancy signal that makes it possible to verify integrity of the transmitted cycles.

13. The portable acquisition and detection system according to claim 1, wherein the transmitter is configured to transmit several digital signals on a same communication channel, according to a temporal multiplexing communication method allowing data transmission in successive cycles of the same communication channel, each cycle being divided into a plurality of time slots, where each cycle has a time slot reserved for transmission of the digital refereeing signal.

14. An audio-digital communication terminal by temporal multiplexing allowing a transmission of audiometric data in successive cycles of a same communication channel, each cycle being divided into a plurality of time slots, comprising:

an audio transceiver allowing the reception and transmission of voice;

an audio-digital converter in connection with the audio transceiver in order to convert the voice into audiometric data;

a controller in connection with the audio-digital converter and designed to receive, as input, the audiometric data from the audio-digital converter, and deliver it as output in the time slots of the cycles of the communication channel;

a radio transmitter/receiver adapted to transmit audiometric data in the successive cycles of the same communication channel; and a portable acquisition and detection system according to claim 1, said portable acquisition and detection system being integrated into said audio-digital communication terminal with:

the acoustic sensor of the portable system, which is integrated into the audio transceiver of the communication terminal;

the analog/digital converter of the portable system, which is integrated into the audio-digital converter of the communication terminal;

the digital processor of the portable system, which is integrated into the controller of the communication terminal; and with the transmitter of the portable system, which is integrated into the radio transmitter/receiver of the communication terminal, each cycle of the communication channel having a time slot reserved for the transmission of the digital refereeing signal.

15. A control installation of playing time of a sporting event, said installation comprising:

several audio-digital communication terminals carried by referees for the sporting event to allow audio communication between said referees, where at least one of said communication terminals is in accordance with claim 14; and a fixed system for controlling playing time of a sporting event, said fixed system being in radio communication with the portable acquisition and detection system equipping the audio-digital communication terminal(s), said fixed system comprising:

a receiver in radio communication with the transmitter of the portable acquisition and detection system, said receiver being designed to receive the digital refereeing signal;

a controller connected to the receiver and designed to communicate a control refereeing signal to a time measuring instrument in response to the reception of a digital refereeing signal by the receiver; and wherein the time measuring instrument is configured for counting down the playing time, said time measuring instrument being connected to the controller and configured to stop and/or resume the countdown of the playing time in response to the communication of the control refereeing signal;

wherein the fixed system for controlling the playing time is in radio communication with the portable acquisition or detection system equipping the audio-digital communication terminal(s).

16. A control installation of playing time of a sporting event, said installation comprising:

at least one portable and detection acquisition system according to claim 1; and a fixed system for controlling playing time of a sporting event, said fixed system being in radio communication with said portable acquisition and detection system(s), said fixed system comprising:

a receiver in radio connection with the transmitter of the or each portable acquisition and detection system, said receiver being designed to receive the or each digital refereeing signal;

a controller connected to the receiver and designed to deliver a control refereeing signal to a time measuring instrument in response to the reception of a digital refereeing signal by the receiver; and the time measuring instrument for counting down the playing time, connected to the controller and configured to stop or resume the countdown of the playing time in response to the delivery of the control refereeing signal from the controller;

wherein the fixed system for controlling the playing time is in radio communication with the or each portable acquisition or detection system.

* * * * *